US010854123B2

(12) United States Patent
Kim et al.

(10) Patent No.: US 10,854,123 B2
(45) Date of Patent: Dec. 1, 2020

(54) ORGANIC LIGHT EMITTING DIODE DISPLAY DEVICE

(71) Applicant: LG Display Co., Ltd., Seoul (KR)

(72) Inventors: Min-Cheol Kim, Gunpo-si (KR); Jae-Hong Kim, Paju-si (KR); Hee-Eun Lee, Seoul (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/514,645

(22) Filed: Jul. 17, 2019

(65) Prior Publication Data

US 2020/0211430 A1 Jul. 2, 2020

(30) Foreign Application Priority Data

Dec. 26, 2018 (KR) ..... 10-2018-0169514

(51) Int. Cl.

| | |
|---|---|
| ***G09G 3/00*** | (2006.01) |
| ***G09G 3/3233*** | (2016.01) |
| ***G09G 3/3275*** | (2016.01) |
| ***G09G 3/3266*** | (2016.01) |

(52) U.S. Cl.

CPC ..... *G09G 3/007* (2013.01); *G09G 3/3233* (2013.01); *G09G 3/3266* (2013.01); *G09G 3/3275* (2013.01); *G09G 2310/027* (2013.01); *G09G 2310/08* (2013.01); *G09G 2320/046* (2013.01); *G09G 2320/103* (2013.01)

(58) Field of Classification Search

CPC ..... G06F 3/0418; G06F 3/044; G09G 3/36; G09G 3/3677; G09G 2310/0286; G09G 2310/08; G09G 2320/103; H01L 27/1225; G02F 1/13338; G02F 1/1368

See application file for complete search history.

(56) References Cited

U.S. PATENT DOCUMENTS

| | | | | |
|---|---|---|---|---|
| 2007/0109284 | A1* | 5/2007 | Yamazaki | G09G 3/3233 345/204 |
| 2016/0203754 | A1* | 7/2016 | Lee | G09G 5/003 345/214 |
| 2019/0191082 | A1* | 6/2019 | Uehara | H04N 5/23287 |

* cited by examiner

*Primary Examiner* — Nelson M Rosario
(74) *Attorney, Agent, or Firm* — Fenwick & West LLP

(57) ABSTRACT

Disclosed herein is an organic light emitting diode (OLED) display device capable of improving image sticking improvement capability by expanding an image shift orbit or changing the shape of an image shift orbit using a maximum shift range. An image processor of an OLED display device independently determines a pixel shift amount in a horizontal direction and a pixel shift amount in a vertical direction in consideration of a maximum shift range in each of the horizontal and vertical directions, simultaneously applies the determined pixel shift amounts in the horizontal and vertical directions to shift a source image, and outputs the shifted image.

15 Claims, 13 Drawing Sheets

H : HORIZONTAL ORBIT SIZE
V : VERTICAL ORBIT SIZE
N : INTEGER OF N≥0

| ORBIT SIZE CHARACTERISTIC | SHIFT SHAPE | FEATURE |
|---|---|---|
| H ≠ N x V (ex : 22 x 10) |  | IMAGE IS SHIFTED TO MAX IN HORIZONTAL DIRECTION AND IS SHIFTED ALONG ANOTHER ORBIT |

H : HORIZONTAL ORBIT SIZE
V : VERTICAL ORBIT SIZE
N : INTEGER OF N≥0

| ORBIT SIZE CHARACTERISTIC | SHIFT SHAPE | FEATURE |
|---|---|---|
| H = 2N x V (ex : 40 x 10) |  | EXPANDED DIAMOND SHAPE |

H : HORIZONTAL ORBIT SIZE
V : VERTICAL ORBIT SIZE
N : INTEGER OF N≥0

| ORBIT SIZE CHARACTERISTIC | SHIFT SHAPE | FEATURE |
|---|---|---|
| H = (2N+1) x V (ex : 30 x 10) |  | IMAGE IS SHIFTED TO MAX IN HORIZONTAL DIRECTION AND SAME ORBIT IS REPEATED |

ORGANIC LIGHT EMITTING DIODE DISPLAY DEVICE

CROSS-REFERENCE TO RELATED APPLICATIONS

This application claims the benefit of Republic of Korea Patent Application No. 10-2018-0169514, filed on Dec. 26, 2018, which is incorporated by reference in its entirety.

BACKGROUND

Field of Technology

The present disclosure relates to an organic light emitting diode display device capable of improving image sticking improvement capability by expanding an image shift orbit or changing the shape of an image shift orbit using a maximum shift range.

Discussion of the Related Art

As a display device for displaying an image using digital image data, a liquid crystal display (LCD) using liquid crystal and an organic light emitting diode (hereinafter, OLED) display device using an OLED are mainly used.

The OLED display device has high luminance, a low driving voltage and an ultra-thin film and a free shape, because a self-emission element for enabling an organic emission layer to emit light by recombination of electrons and holes is used.

In the OLED display device, since an OLED element deteriorates due to increase in current stress when being driven for a long time, image sticking may occur in a portion where a fixed pattern or a logo is displayed for a long time.

In order to solve image sticking, the OLED display device uses an orbital driving method of shifting an image frame by one pixel at a predetermined period to disperse cumulative stress of each pixel.

In the orbital driving method of the related art, a rectangular shift method of shifting an image frame by one pixel in a horizontal or vertical direction at a certain period or a diamond shift method of shifting an image frame by one pixel in a diagonal direction is mainly used.

However, the orbital driving method of the related art has a limitation in a maximum shift amount of the image frame in the horizontal and vertical directions. In addition, since the image frame is shifted in a predetermined shift orbit shape, a shift path is limited, thereby decreasing cumulative stress dispersion capability and image sticking improvement capability.

SUMMARY

Accordingly, the present disclosure is directed to an organic light emitting diode display device that substantially obviates one or more problems due to limitations and disadvantages of the related art.

An object of the present disclosure is to provide an organic light emitting diode display device capable of improving image sticking improvement capability by expanding an image shift orbit or changing the shape of an image shift orbit using a maximum shift range.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these objects and other advantages and in accordance with the purpose of the disclosure, as embodied and broadly described herein, an image processor of an OLED display device independently determines a pixel shift amount in a horizontal direction and a pixel shift amount in a vertical direction in consideration of a maximum shift range in each of the horizontal and vertical directions, simultaneously applies the determined pixel shift amounts in the horizontal and vertical directions to shift a source image, and outputs the shifted image.

The image processor may sequentially shift the source image by the determined pixel shift amounts in the maximum shift range and change a shift direction and sequentially shift the source image in an opposite direction when the pixel shift amount reaches the maximum shift amount in each of the horizontal and vertical directions.

A shape of a shift orbit of the source image may be changed according to a size of the maximum shift range.

When a size of the shift orbit in the horizontal direction is not an integral multiple of that of the shift orbit in the vertical direction, the source image may be shifted to the maximum shift range in the horizontal direction and then be shifted along a shift orbit having another shape.

When a size of the shift orbit in the horizontal direction is an even-numbered integral multiple of that of the shift orbit in the vertical direction, the source image may be shifted along a diamond orbit expanded in the horizontal direction.

When a size of the shift orbit in the horizontal direction is an odd-numbered integral multiple of that of the shift orbit in the vertical direction, the source image may be shifted to the maximum shift range in the horizontal direction and then may be shifted along the same shift orbit.

The image processor may shift the source image when an image, in which scene change or motion occurs, having a difference between an image of a previous frame and an image of a current frame equal to or greater than a threshold value is displayed through image analysis.

The image processor may change the maximum shift range in each of the horizontal and vertical directions as a driving time has elapsed and randomly change a shape of an image shift orbit according to change in maximum shift range.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s), and together with the description serve to explain the principle of the disclosure. In the drawings:

FIG. 1 is a block diagram showing an OLED display device according to an embodiment of;

DETAILED DESCRIPTION

Hereinafter, exemplary embodiments of the present disclosure will be described with reference to the drawings.

Figure 1:
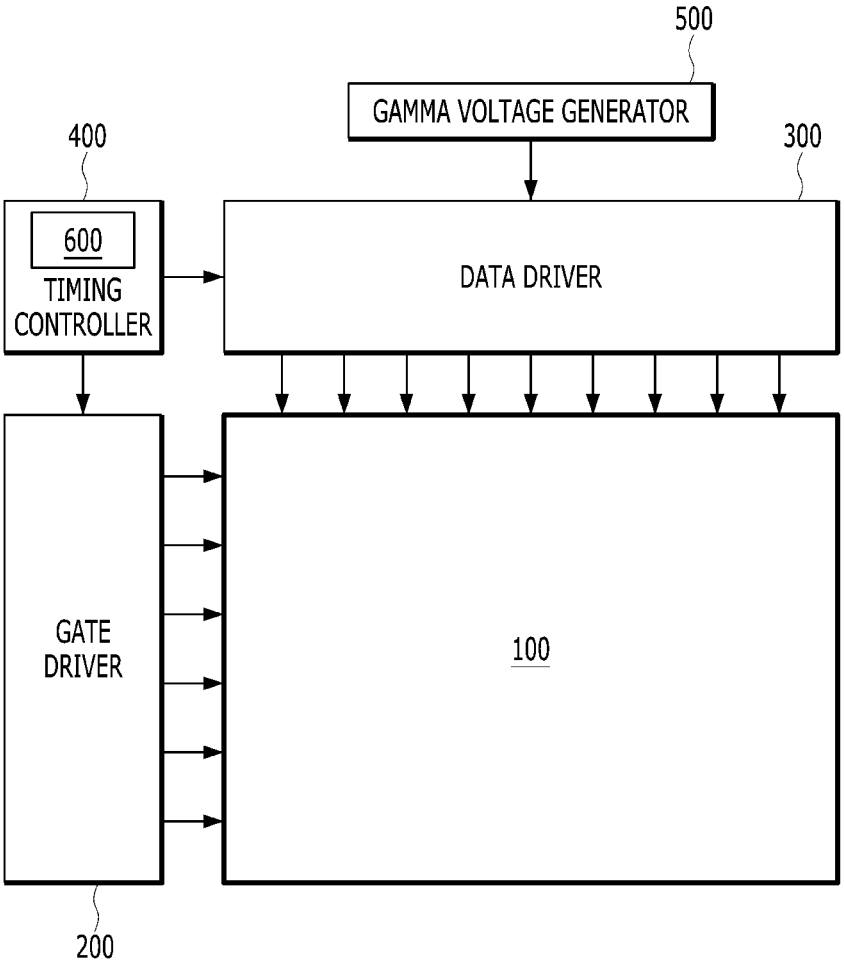
Figure 2:
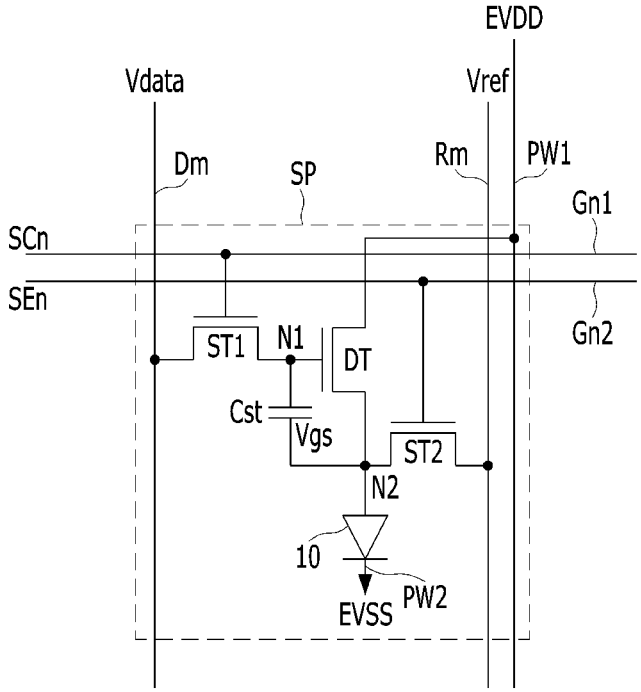
FIG. 2 is an equivalent circuit diagram showing the configuration of a subpixel of an OLED display according to an embodiment.
Figure 3:
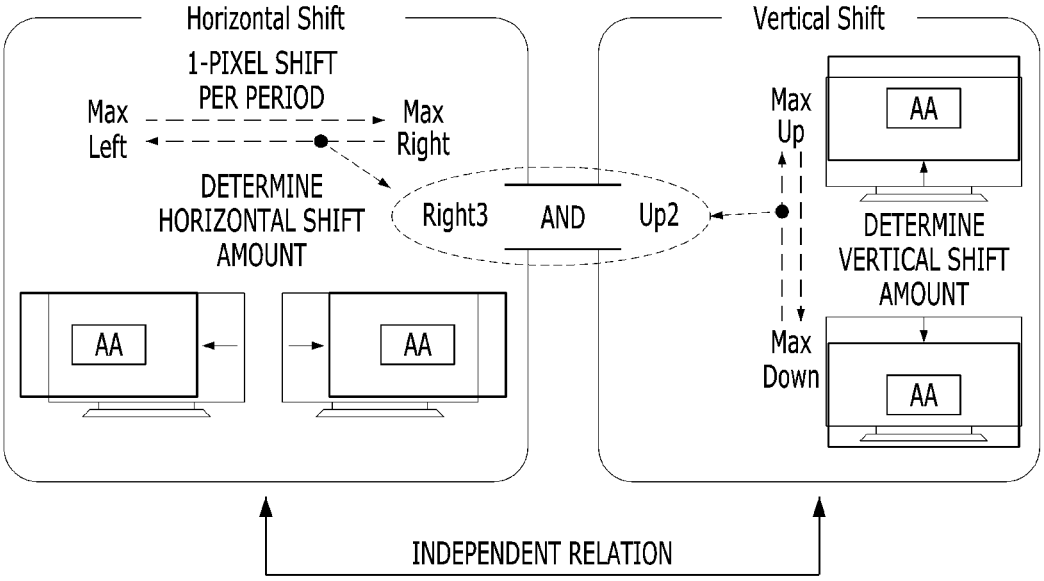
FIG. 3 is a view schematically showing a pixel shift amount determination method according to an embodiment.

FIG. 1 is a block diagram showing an OLED display device according to an embodiment, FIG. 2 is an equivalent circuit diagram showing the configuration of a subpixel shown in FIG. 1, FIG. 3 is a view schematically showing a pixel shift amount determination method according to an embodiment of the present disclosure, and FIGS. 4A to 4D are views showing comparison in shape between an image shift orbit according to an embodiment and a shift orbit of a comparative example.

Referring to FIG. 1, the OLED display device includes a panel 100, a gate driver 200, a data driver 300, a timing controller 400, and a gamma voltage generator 500.

The panel 100 displays an image through a pixel array. The panel 100 may use any one of various pixel structures shown in FIG. 1. The basic pixel of the pixel array may include subpixels of two, three or four colors of white (W), red (R), green (G), and blue (B). Meanwhile, the panel 100 may be provided or attached with a touch sensor.

Referring to FIG. 2, each subpixel SP includes an OLED element 10 connected between a high driving voltage (first driving voltage EVDD) line PW1 and a low driving voltage (second driving voltage EVSS) line PW2, and a pixel circuit including at least first and second switching TFTs ST1 and ST2, a driving TFT DT, and a storage capacitor Cst in order to independently drive the OLED element 10. The pixel circuit may have various configurations in addition to the configuration of FIG. 2.

The switching TFTs ST1 and ST2 and the driving TFT DT may include an amorphous silicon (a-Si) TFT, a polysilicon (poly-Si) TFT, an oxide TFT or an organic TFT.

The OLED element 10 includes an anode connected to a source node N2 of the driving TFT DT, a cathode connected to the EVSS line PW2, and an organic light emitting layer between the anode and the cathode. The anode may be independently formed in each subpixel and the cathode may be a common electrode shared by all subpixels. When the OLED element 10 receives driving current from the driving TFT DT, electrons from the cathode are injected into the organic light emitting layer, holes from the anode are injected into the organic light emitting layer, and a fluorescent or phosphorescent material emits light due to recombination of the electrons and the holes in the organic light emitting layer, thereby generating light with brightness proportional to the current value of the driving current.

The first switching TFT ST1 is driven by a scan pulse SCn supplied from the gate driver 200 to one gate line Gn1 and supplies, to a gate node N1 of the driving TFT DT, a data voltage Vdata supplied from the data driver 300 to a data line Dm.

The second switching TFT ST2 is driven by a sense pulse SEn supplied from the gate driver 200 to another gate line Gn2 and supplies, to a source node N2 of the driving TFT DT, a reference voltage Vref supplied from the data driver 300 to a reference line Rm.

The storage capacitor Cst connected between the gate node N1 and source node N2 of the driving TFT DT stores a voltage difference between the data voltage Vdata and the reference voltage Vref respectively supplied to the gate node N1 and the source node N2 through the first and second switching TFTs ST1 and ST2 as the driving voltage Vgs of the driving TFT DT and holds the stored driving voltage Vgs during an emission period in which the first and second switching TFTs ST1 and ST2 are turned off.

The driving TFT DT controls current supplied from the EVDD line PW1 according to the driving voltage Vgs supplied from the storage capacitor Cst to supply driving current set by the driving voltage Vgs, such that the OLED element 10 emits light.

Meanwhile, in the case of a sensing mode of the subpixel SP, the driving TFT DT is driven by receiving the sensing data voltage Vdata supplied through the data line Dm and the first switching TFT ST1 and the reference voltage Vref supplied through the reference line Rm and the second switching TFT ST2. Current, to which the electrical characteristics (Vth and mobility) of the driving TFT (DT) or deterioration characteristics of the OLED element 10 are applied, is stored in a line capacitor of the reference line Rm in a floating state as a voltage through the second switching TFT ST2. The data driver 300 samples and holds the voltage stored in the reference line Rm, converts the voltage into sensing data of each subpixel SP, and outputs the sensing data to the timing controller 400.

The gate driver 200 and the data driver 300 shown in FIG. 1 may be referred to as a panel driver for driving the panel 100.

The gate driver 200 receives a plurality of gate control signals from the timing controller 400, performs shift operation, and individually drives the gate lines of the panel 100. The gate driver 200 supplies a scan signal of a gate on voltage to a corresponding gate line in a driving period of each gate line and supplies a gate off voltage to the corresponding gate line in a non-driving period of each gate line.

The gamma voltage generator 500 generates and supplies a plurality of reference gamma voltages having different voltage levels to the data driver 300. The gamma voltage generator 500 may generate a plurality of reference gamma voltages corresponding to the gamma characteristics of the display device and supply the reference gamma voltages to the data driver 300, under control of the timing controller 400. The gamma voltage generator 500 may receive gamma data from the timing controller 400, adjust a reference gamma voltage level according to the gamma data, and output the reference gamma voltage to the data driver 300. The gamma voltage generator 500 may adjust and output a high voltage to the data driver 300 according to peak luminance control of the timing controller 400.

The data driver 300 is controlled according to a data control signal received from the timing controller 400 and converts digital data received from the timing controller 400 into an analog data signal, and supplies the analog data signal to the data lines of the panel 100. At this time, the data driver 300 converts the digital data into the analog data signal using gray-scale voltages obtained by subdividing the plurality of reference gamma voltages supplied from the gamma voltage generator 500. The data driver 300 supplies the reference voltage Vref to the reference lines of the panel 100 under control of the timing controller 400.

The data driver 300 may supply the sensing data voltage to the data line to drive each subpixel, sense pixel current indicating the electrical characteristics of the driven subpixel through the reference line using a voltage sensing method or a current sensing method, convert the sensing signal into sensing data, and supply the sensing data to the timing controller 400, in the sensing mode, under control of the timing controller 400.

The timing controller 400 receives a source image and timing control signals from a host system. The host system may be any one of a computer, a TV system, a set-top box, or a system of a portable terminal such as a tablet or a mobile phone. The timing control signals may include a dot clock, a data enable signal, a vertical synchronization signal, a horizontal synchronization signal, etc.

The timing controller 400 generates and supplies a plurality of data control signals for controlling the driving timing of the data driver 300 to the data driver 300 using the received timing control signals and timing setting information stored therein and generates and supplies a plurality of gate control signals for controlling driving timing of the gate driver 200 to the gate driver 400.

The timing controller 400 includes an image processor 600 for performing various image processes with respect to the source image. The image processor 600 performs an image shift process of independently determining a shift amount in a horizontal direction and a shift amount in a vertical direction at certain periods and shifting and outputting the source image according to the determined shift amounts, as shown in FIG. 3. In particular, the image processor 600 may repeatedly perform operation of independently determining the pixel shift amount in each of the horizontal and vertical directions and shifting the image by one pixel in the horizontal and vertical directions according to the determined period and direction as shown in FIG. 3, in consideration of a maximum shift range in the horizontal direction and a maximum shift range in the vertical direction as shown in FIG. 4. The image processor 600 may repeatedly perform operation of shifting the image in the opposite direction when the image shift amount reaches the maximum shift amount in each direction as the result of sequentially shifting the image. This will be described below in detail.

The image processor 600 may further perform a plurality of image processes including image quality correction or luminance correction for reducing power consumption before or after the image shift process. Meanwhile, the image processor 600 may be separated from the timing controller 400 and located to be connected to the input terminal of the timing controller 400. In this case, the output of the image processor 600 may be supplied to the data driver 300 through the timing controller 400.

The timing controller 400 may further perform correction by applying a compensation value for the characteristic deviation of each subpixel stored in a memory before the output of the image processor is supplied to the data driver 300. In the sensing mode, the timing controller 400 may sense the electrical characteristics (Vth and mobility of the driving TFT, Vth of the OLED, etc.) of each subpixel of the panel 100 through the data driver 300 and update the compensation value of each subpixel stored in the memory 500 using the result of sensing.

Referring to FIGS. 3 and 4, the image processor 600 may shift the reference points P0 and PP0 of the source image in the horizontal and vertical directions, that is, in a diagonal direction, according to the pixel shift amounts determined in the horizontal and vertical directions, thereby shifting the source image. In other words, the image processor 600 may determine the pixel shift amount in the horizontal direction and the pixel shift amount in the vertical direction for the reference points P0 and PP0 of the source image and shift the reference points P0 and PP0 of the source image by the determined pixel shift amounts.

Figure 4A:
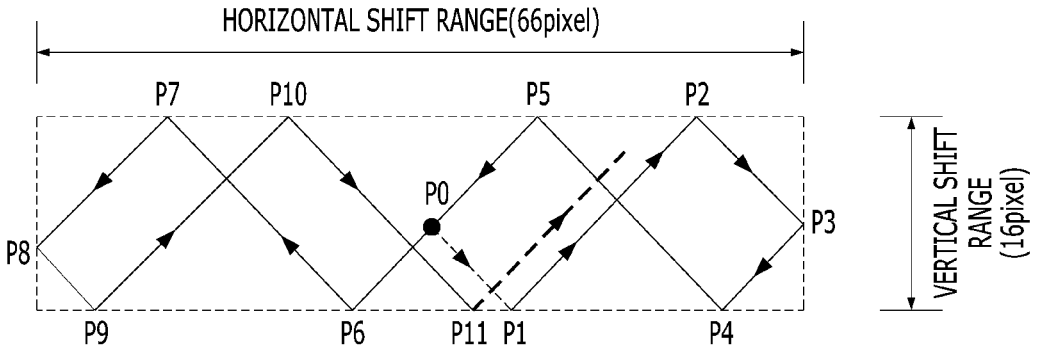
FIGS. 4A to 4D are views showing comparison in shape between an image shift orbit according to an embodiment and a shift orbit of a comparative example.
Figure 4B:
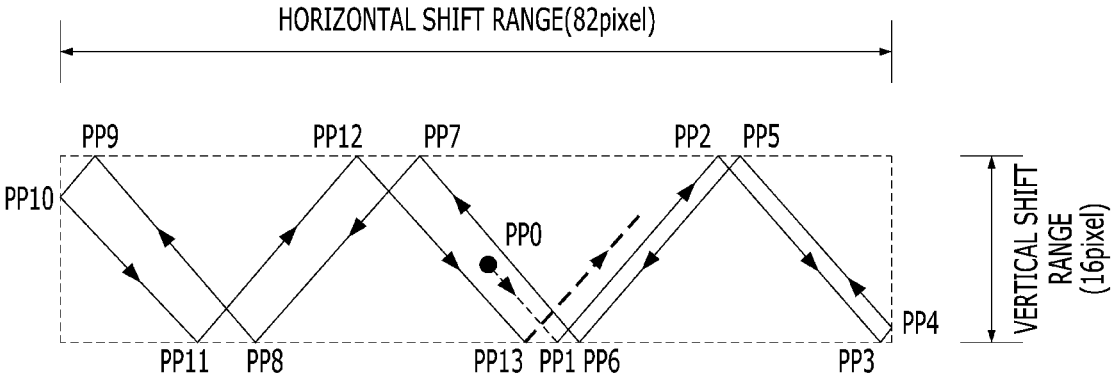
Figure 4C:
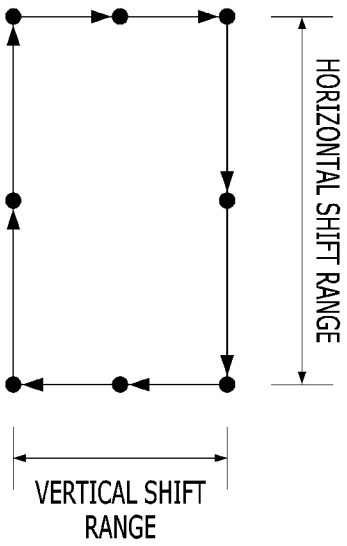
Figure 4D:
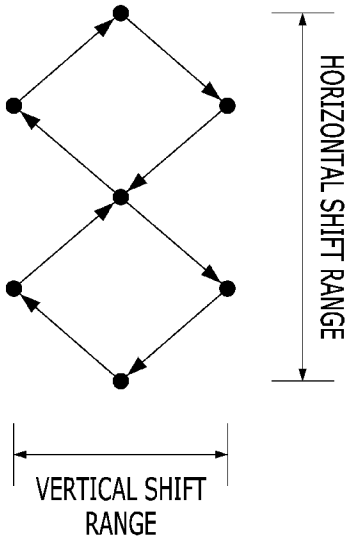

Therefore, it can be seen that the shift orbits of the reference points P0 and PP0 of the source image may expand by the maximum shift range in the horizontal direction with time, as shown in FIGS. 4A and 4B, and the shape of the shift orbit is not limited to a specific shape such as a rectangle or a diamond as shown in FIGS. 4C and 4D and is changed with time.

Referring to FIG. 4A, in a virtual maximum shift range having the maximum shift range (66 pixels) in the horizontal direction and the maximum shift range (16 pixels) in the vertical direction, the reference point P0 of the source image may be shifted along the shift orbit sequentially passing through points P1 to P11 over time.

Referring to FIG. 4B, in a virtual maximum shift range having the maximum shift range (82 pixels) in the horizontal direction and the maximum shift range (16 pixels) in the vertical direction, the reference point PP0 of the source image may be shifted along the shift orbit sequentially passing through points PP1 to PP13 over time.

Referring to FIGS. 4A and 4B, it can be seen that, since the maximum shift range in the horizontal direction is changed, the shapes of the shift orbits, through which the reference points P0 and PP0 of the source image pass over time, may be different and expansion in the horizontal direction is realized. In addition, it can be seen that the shift orbits of the reference points P0 and PP0 of the source image pass through various locations without a repeated cycle even if a relatively long time has elapsed. As compared to the conventional method of repeatedly shifting the image in the rectangular or diamond-like shape as shown in FIGS. 4C and 4D, the cumulative stress of each pixel is more widely dispersed, thereby improving image sticking improvement capability.

Referring to FIG. 4A, it can be seen that the vertical shift direction V_direction is reversed when the shift orbit of the reference point P0 of the source image passes through points P1, P2, P4, P5, P6, P7, P9, P10 and P11. In contrast, it can be seen that the horizontal shift direction H_direction is reversed when the shift orbit of the reference point P0 of the source image passes through points P3 and P8.

Referring to FIG. 4B, it can be seen that the vertical shift direction V_direction is reversed when the shift orbit of the reference point PP0 of the source image passes through points PP1, PP2, PP3, PP5, PP6, PP7, PP8, PP9, PP11, PP12 and PP13. In contrast, it can be seen that the horizontal shift direction H_direction is reversed when the shift orbit of the reference point PP0 of the source image passes through points PP4 and PP10.

In other words, it can be seen that the shift amounts of the reference points P0 and PP0 of the source image are independently determined in the horizontal direction and the vertical direction, such that the reverse location of the vertical shift direction and the reverse location of the horizontal shift direction are different from each other.

Figure 5:
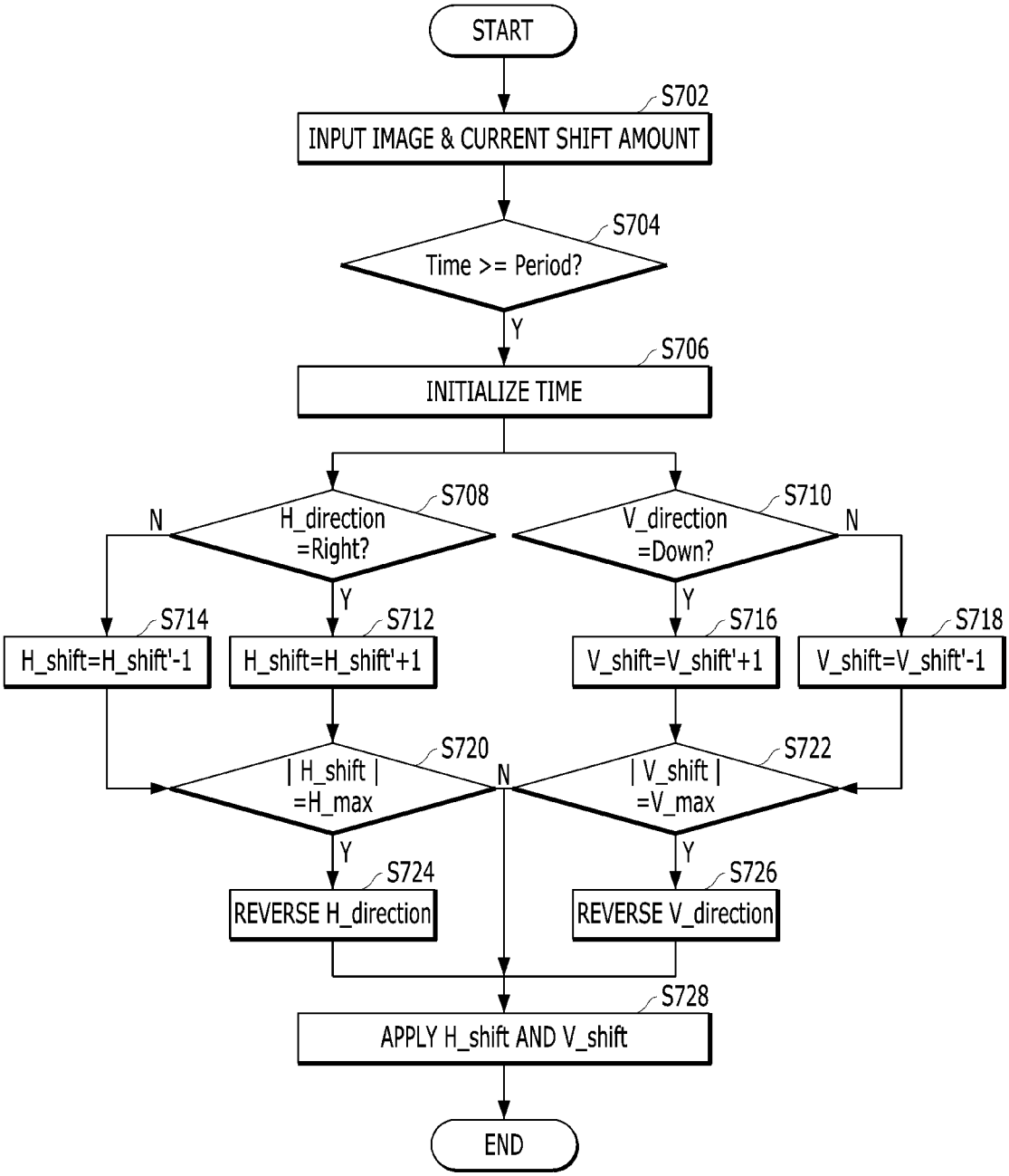
FIG. 5 is a flowchart illustrating a pixel shift amount determination method of an OLED display device according to an embodiment.

FIG. 5 is a flowchart illustrating a pixel shift amount determination method of an OLED display device according to an embodiment, which is performed by the image processor 600 shown in FIG. 1.

In FIG. 5, Time means a time from initialization to a current frame and Period means a pixel shift period in one embodiment. H_direction means a horizontal shift direction (right and left) and V_direction means a vertical shift direction (down and up) in one embodiment. H_shift means the current pixel shift amount in the horizontal direction, V_shift means the current pixel shift amount in the vertical direction, H_max means a maximum shift amount (shift range) in the horizontal direction, and V_max means a maximum shift amount (shift range) in the vertical direction in one embodiment.

Referring to FIG. 5, the image processor 600 receives an input image and a pixel shift amount for a current frame (S702), initializes a time Time (S706) when the current frame time Time corresponds to the shift period Period (S704: Y), and shifts the image as follows.

The image processor 600 determines the horizontal shift direction H_direction of the input image (S708) and determines the vertical shift direction V_direction (S710).

The image processor 600 outputs a value obtained by adding 1 (pixel shift amount) to a previous horizontal shift amount H_shift' as a current horizontal shift amount H_shift=H_shift'+1 (S712), when the horizontal shift direction H_direction is a right direction (S708: Y). In contrast, the image processor 600 outputs a value obtained by subtracting 1 (pixel shift amount) from the previous horizontal shift amount H_shift' as a current horizontal shift amount H_shift=H_shift'−1 (S712), when the horizontal shift direction H_direction is a left direction (S708: N).

The image processor 600 maintains the previous horizontal shift direction H_direction until the absolute value of the output current horizontal shift amount H_shift becomes the horizontal maximum shift range H_max (S720: N) and outputs the current horizontal shift amount H_shift determined in the above step in step S728. In contrast, when the absolute value of the current horizontal shift amount H_shift becomes the horizontal maximum shift range H_max (S720: Y), the image processor 600 reverses the horizontal shift direction H_direction (S724) and outputs the current horizontal shift amount H_shift determined in the above step in step S728.

Meanwhile, the image processor 600 outputs a value obtained by adding 1 (pixel shift amount) to a previous vertical shift amount V_shift' as a current vertical shift amount V_shift=V_shift'+1 (S716), when the vertical shift direction V_direction is a downward direction (S710: Y). In contrast, the image processor 600 outputs a value obtained by subtracting 1 (pixel shift amount) from the previous vertical shift amount V_shift' as a current vertical shift amount V_shift=V_shift'−1 (S714), when the vertical shift direction V_direction is an upward direction (S710: N).

The image processor 600 maintains the previous vertical shift direction V_direction until the absolute value of the output current vertical shift amount V_shift becomes the vertical maximum shift range V_max (S722: N) and outputs the current vertical shift amount V_shift determined in the above step in step S728. In contrast, when the absolute value of the current vertical shift amount V_shift becomes the vertical maximum shift range V_max (S722: Y), the image processor 600 reverses the vertical shift direction V_direction (S726) and outputs the current vertical shift amount V_shift determined in the above step in step S728.

Next, the image processor 600 may shift the reference points P0 and PP0 of the input image by the current horizontal shift amount H_shift and the current vertical shift amount V_shift by applying the current horizontal shift amount H_shift and the current vertical shift amount V_shift determined in the above steps, thereby shifting and outputting the input image.

FIG. 6 is a view showing various image shift orbit shapes according to the sizes of an image shift orbit according to an embodiment.

Figure 6A:
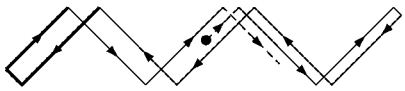
FIGS. 6A-6C are views showing various image shift orbit shapes according to the sizes of an image shift orbit according to an embodiment.

Referring to FIG. 6A, it can be seen that, when the horizontal shift range H is not an integral multiple N of the vertical shift range V (e.g., 22*10), the image is shifted to the horizontal maximum shift range H_max and then is changed to an orbit having another shape, such that the shape of the image shift orbit varies with time.

Figure 6B:
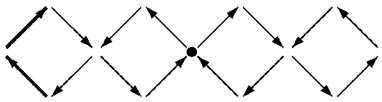

Referring to FIG. 6B, it can be seen that, when the horizontal shift range H is an even-numbered integral multiple 2N of the vertical shift range V (e.g., 40*10), the image is shifted along a diamond orbit expanded in the horizontal direction.

Figure 6C:
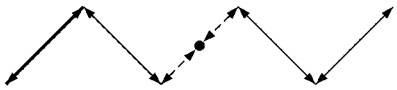

Referring to FIG. 6C, it can be seen that, when the horizontal shift range H is an odd-numbered integral multiple 2N+1 of the vertical shift range V (e.g., 30*10), the image is shifted to the horizontal maximum shift range H_max and then the same orbit is repeated.

In one embodiment, it can be seen that, since the horizontal and vertical shift amounts for determining image shift locations are independently determined, the shift orbit shape is changed when the shift rule in the horizontal direction or the shift rule in the vertical direction is changed. In addition, the shift orbit shape may be changed according to change in shift amount according to period in the horizontal and vertical directions, and shift period, in addition to the maximum shift range. As shown in FIGS. 6B and 6C, it can be seen that, when the horizontal shift range is an integral multiple of the vertical shift range, the image shift orbit proceeds in a regular form returning to the origin after one cycle (left and right shift) in the horizontal direction.

Figure 7:
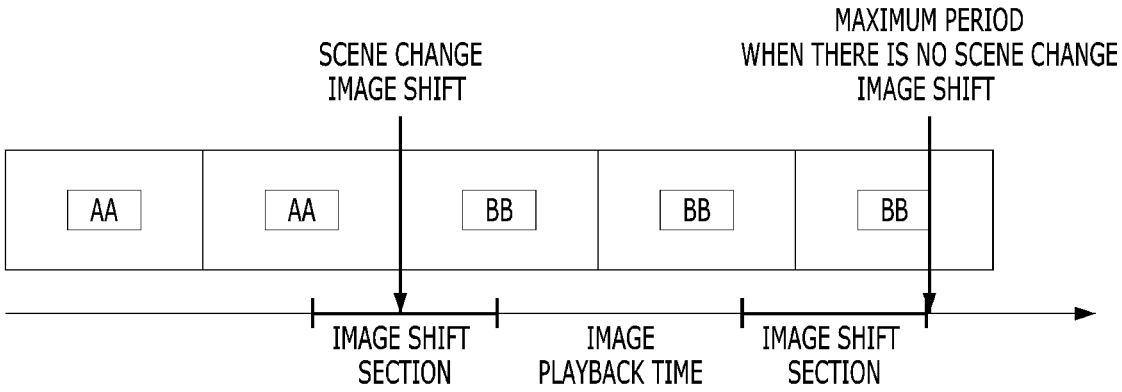
FIG. 7 is a view showing an image shift time point of an OLED display device according to an embodiment.
Figure 8:
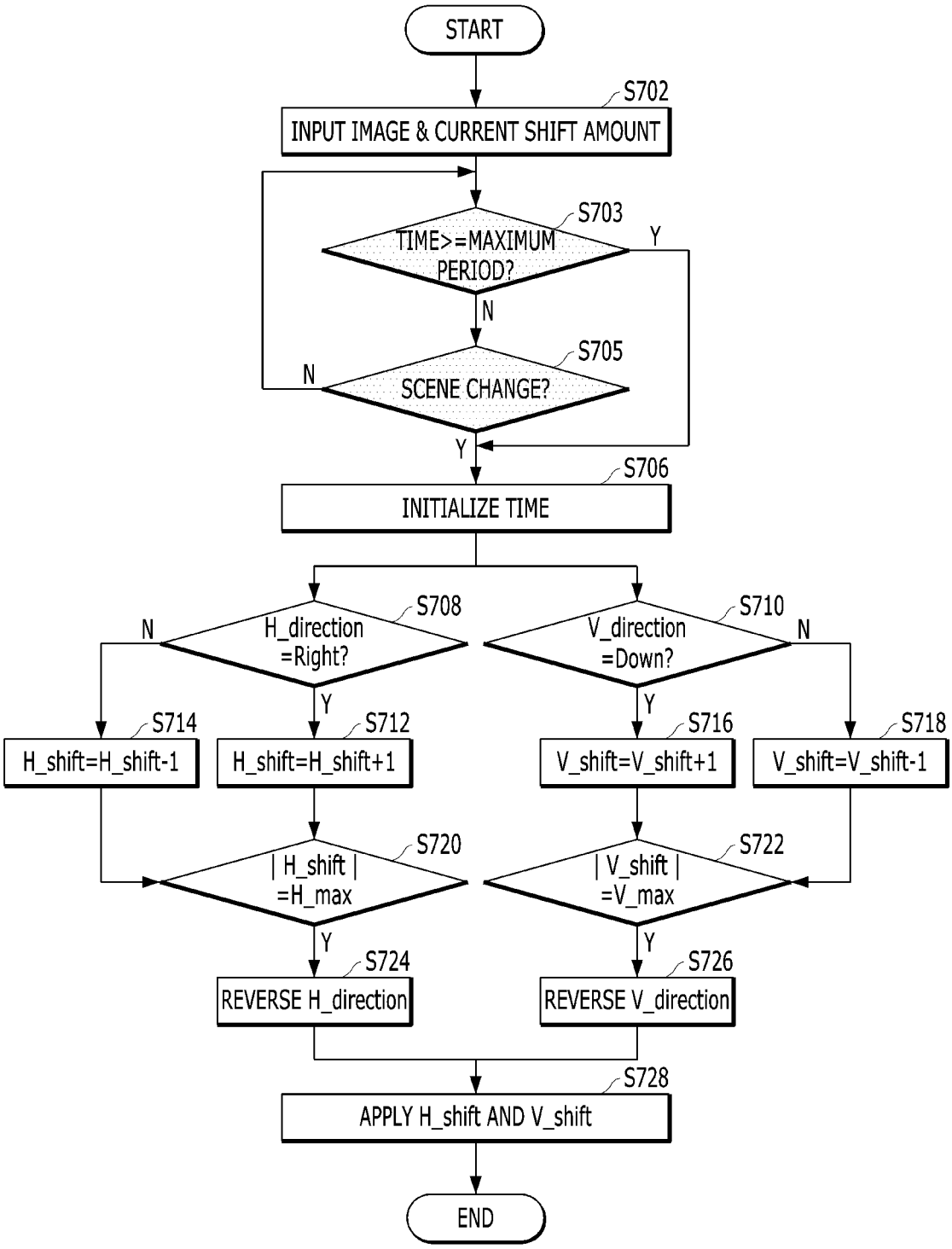
FIG. 8 is a flowchart illustrating an image shift method of an OLED display device according to an embodiment.

FIGS. 7 and 8 are views showing an image shift method of an OLED display device according to an embodiment.

Referring to FIG. 8, step S705 of determining scene change as an image shift condition is further included and a maximum period is determined instead of a certain period as compared to FIG. 5. A difference will be focused upon.

Referring to FIGS. 7 and 8, the image processor 600 may not perform image shift at a certain period as shown in FIG. 5 but may set an image shift section (time range) and perform image shift when scene change or motion occurs within the set section.

The image processor 600 may use a method of calculating a difference in per-pixel luminance between a current frame image and a previous frame image in order to determine scene change or motion. For example, when a sum of per-pixel data differences between the current frame and the previous frame is equal to or greater than a threshold, an image with large scene change or motion may be determined and image shift may be performed. The image processor 600 may perform image shift when motion/scene change is not detected until the set maximum period (S7805: N and S703: Y).

Therefore, the image processor 600 may shift the image when there is a lot of motion or scene change in the image, thereby preventing image shift from being recognized and improving image quality.

Figure 9:
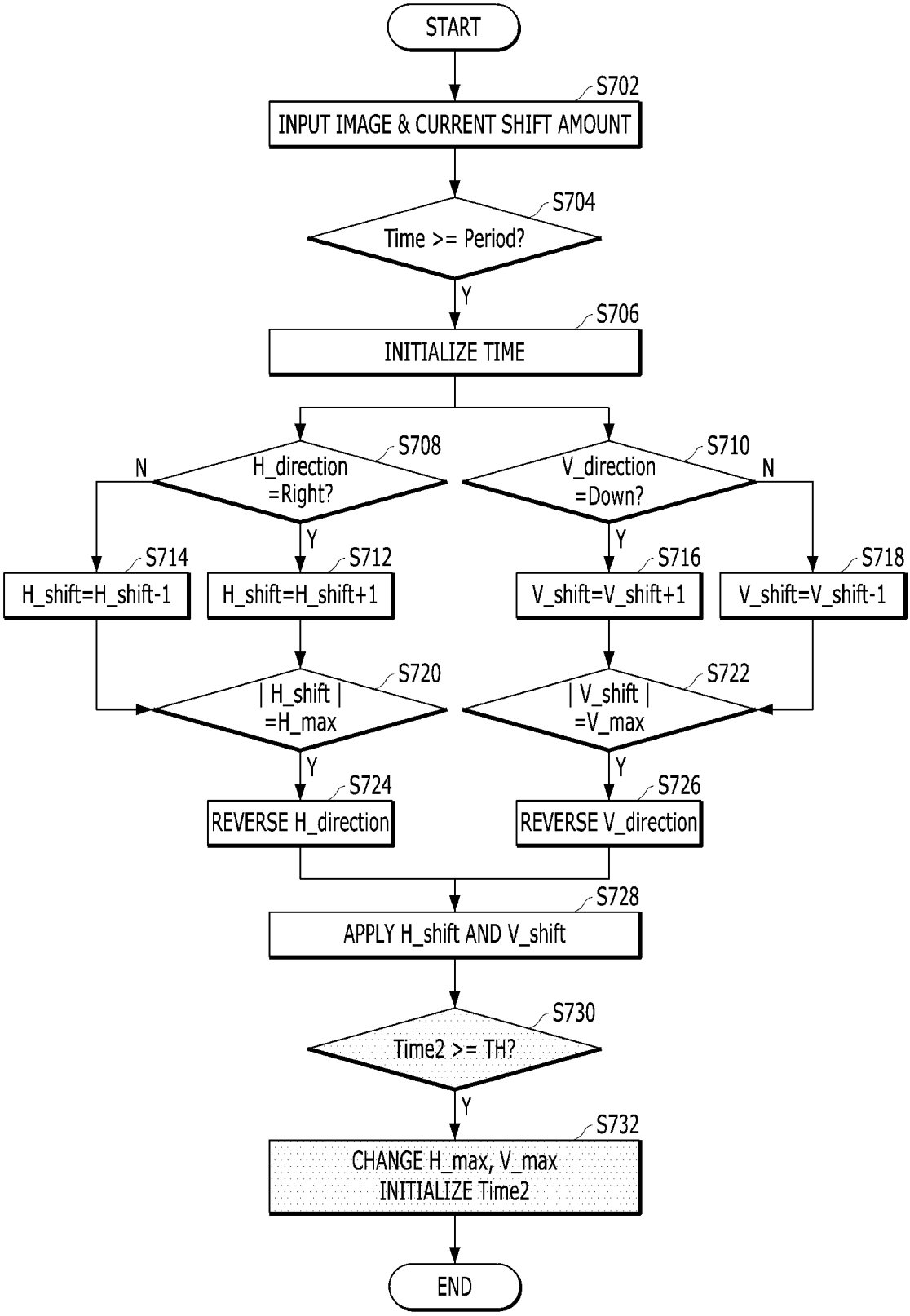
FIG. 9 is a flowchart illustrating an image shift method of an OLED display device according to an embodiment.

FIG. 9 is a flowchart illustrating an image shift method of an OLED display device according to an embodiment.

Referring to FIG. 6, the image processor 600 may change maximum shift amounts H_max and V_max influencing the shape of the image shift orbit to randomly change the shape of the image shift orbit.

For example, as shown in FIG. 9, by adding step S732 of changing the horizontal and vertical maximum shift amounts H_max and V_max when a driving time timet becomes a threshold TH (S730: Y) after the image is shifted by applying the horizontal shift amount H_shift and the vertical shift amount V_shift of the current input image shown in FIG. 5 (S728), the first to third image shift orbits shown in FIGS. 6(*a*) to 6(*c*) may be alternately used.

Meanwhile, in the image shift technology, as the maximum shift amount of the image shift orbit increases, the image sticking improvement effect increases but artifacts (black line) and memory consumption may increase due to image shift. Accordingly, the maximum shift amount may be determined in consideration of the image sticking improvement effect, artifact recognition and the memory. For example, in full high definition (FHD), the horizontal maximum shift size Max Left to Max Right is 10 to 50 pixels and the vertical maximum shift size max Down to max Up may be set to 3 to 30 pixels.

In the OLED display device according to one embodiment, the shape of the image shift orbit is changed according to the maximum shift amount as shown in FIG. 6, due to the characteristics of cyclone shift in which horizontal and vertical shifts are independently performed. Accordingly, as shown in FIG. 9, by adding the step of changing the maximum shift amounts H_max and V_max according to the predetermined period TH, the shape of the image shift orbit formed according to the horizontal and vertical shift amounts may be randomly used. Accordingly, it is possible to reduce cumulative stress by applying various image shift orbits.

Figure 10:
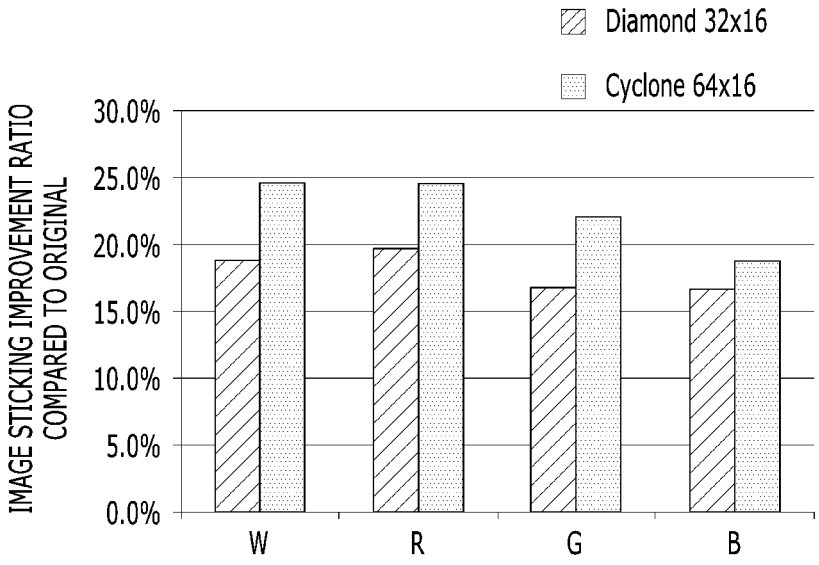
FIG. 10 is a graph showing comparison in an image sticking improvement ratio between an OLED display device according to an embodiment and a comparative example.

FIG. 10 is a graph showing comparison in an image sticking improvement ratio between an OLED display device according to an embodiment and a comparative example.

Referring to FIG. 10, it can be seen that the image sticking improvement capability is improved by about 4% as the result of simulating the image sticking improvement effect of the OLED display device according to one embodiment, to which an image shift orbit having a maximum shift range having a size of 64*16 is applied, and the OLED display device according to the comparative example, to which a diamond image shift orbit having a size of 32*16 is applied.

As described above, in the OLED display device according to one embodiment, the pixel shift amounts in the horizontal and vertical directions are independently determined and the image shift orbit is expanded in the horizontal direction or the shape of the image shift orbit is changed according to the maximum shift ranges in the horizontal and vertical directions, thereby more widely dispersing the cumulative stress of each pixel and improving image sticking improvement capability.

In the OLED display device according to one embodiment, the image is shifted when a lot of motion occurs in an image or when scene change occurs through image analysis, thereby preventing image shift from being recognized and improving recognized image quality.

In the OLED display device according to one embodiment, the maximum shift range of each direction is changed with time to randomly change the shape of the image shift orbit, thereby variously changing an image shift path and further improving image sticking improvement capability.

It will be apparent to those skilled in the art that various modifications and variations can be made in the present disclosure without departing from the spirit or scope of the disclosure. Therefore, the technical scope of the present disclosure should not be limited to the detailed description of the specification, but should be defined by the claims.

What is claimed is:

1. An organic light emitting diode (OLED) display device comprising:

a panel configured to display an image;

a panel driver configured to drive the panel; and an image processor configured to independently determine a pixel shift amount in a horizontal direction and a pixel shift amount in a vertical direction in consideration of a maximum shift range in each of the horizontal and vertical directions, to simultaneously apply the determined pixel shift amounts in the horizontal and vertical directions to shift a source image, and to output the shifted image to the panel driver, wherein a shape of a shift orbit of the source image is changed according to a size of the maximum shift range, wherein, when a size of the shift orbit in the horizontal direction is not an integral multiple of that of the shift orbit in the vertical direction, the source image is shifted to the maximum shift range in the horizontal direction and then is shifted along a shift orbit having another shape.

2. The OLED device of claim 1, wherein the image processor sequentially shifts the source image by the determined pixel shift amounts in the maximum shift range and changes a shift direction and sequentially shifts the source image in an opposite direction when the pixel shift amount reaches the maximum shift amount in each of the horizontal and vertical directions.

3. The OLED device of claim 1, wherein the image processor shifts the source image when an image, in which scene change or motion occurs, having a difference between an image of a previous frame and an image of a current frame equal to or greater than a threshold value is displayed through image analysis.

4. The OLED device of claim 1, wherein the image processor changes the maximum shift range in each of the horizontal and vertical directions as a driving time has elapsed and randomly changes a shape of an image shift orbit according to change in maximum shift range.

5. The OLED device of claim 1, wherein the maximum shift range in the horizontal direction includes 10 to 50 pixels, and wherein the maximum shift range in the vertical direction includes 5 to 30 pixels.

6. An organic light emitting diode (OLED) display device comprising:

a panel configured to display an image;

a panel driver configured to drive the panel; and an image processor configured to independently determine a pixel shift amount in a horizontal direction and a pixel shift amount in a vertical direction in consideration of a maximum shift range in each of the horizontal and vertical directions, to simultaneously apply the determined pixel shift amounts in the horizontal and vertical directions to shift a source image, and to output the shifted image to the panel driver, wherein a shape of a shift orbit of the source image is changed according to a size of the maximum shift range, wherein, when a size of the shift orbit in the horizontal direction is an even-numbered integral multiple of that of the shift orbit in the vertical direction, the source image is shifted along a diamond orbit expanded in the horizontal direction.

7. The OLED device of claim 6, wherein the image processor sequentially shifts the source image by the determined pixel shift amounts in the maximum shift range and changes a shift direction and sequentially shifts the source image in an opposite direction when the pixel shift amount reaches the maximum shift amount in each of the horizontal and vertical directions.

8. The OLED device of claim 6, wherein the image processor shifts the source image when an image, in which scene change or motion occurs, having a difference between an image of a previous frame and an image of a current frame equal to or greater than a threshold value is displayed through image analysis.

9. The OLED device of claim 6, wherein the image processor changes the maximum shift range in each of the horizontal and vertical directions as a driving time has elapsed and randomly changes a shape of an image shift orbit according to change in maximum shift range.

10. The OLED device of claim 6, wherein the maximum shift range in the horizontal direction includes 10 to 50 pixels, and wherein the maximum shift range in the vertical direction includes 5 to 30 pixels.

11. An organic light emitting diode (OLED) display device comprising:

a panel configured to display an image;

a panel driver configured to drive the panel; and an image processor configured to independently determine a pixel shift amount in a horizontal direction and a pixel shift amount in a vertical direction in consideration of a maximum shift range in each of the horizontal and vertical directions, to simultaneously apply the determined pixel shift amounts in the horizontal and vertical directions to shift a source image, and to output the shifted image to the panel driver, wherein a shape of a shift orbit of the source image is changed according to a size of the maximum shift range, wherein, when a size of the shift orbit in the horizontal direction is an odd-numbered integral multiple of that of the shift orbit in the vertical direction, the source image is shifted to the maximum shift range in the horizontal direction and then is shifted along a same shift orbit.

12. The OLED device of claim 11, wherein the image processor sequentially shifts the source image by the determined pixel shift amounts in the maximum shift range and changes a shift direction and sequentially shifts the source image in an opposite direction when the pixel shift amount reaches the maximum shift amount in each of the horizontal and vertical directions.

13. The OLED device of claim 11, wherein the image processor shifts the source image when an image, in which scene change or motion occurs, having a difference between an image of a previous frame and an image of a current frame equal to or greater than a threshold value is displayed through image analysis.

14. The OLED device of claim 11, wherein the image processor changes the maximum shift range in each of the horizontal and vertical directions as a driving time has elapsed and randomly changes a shape of an image shift orbit according to change in maximum shift range.

15. The OLED device of claim 11, wherein the maximum shift range in the horizontal direction includes 10 to 50 pixels, and wherein the maximum shift range in the vertical direction includes 5 to 30 pixels.

* * * * *